US011209230B2

(12) United States Patent
Kujawski et al.

(10) Patent No.: US 11,209,230 B2
(45) **Date of Patent: *Dec. 28, 2021**

(54) FIREARM IDENTIFICATION TAG FOR ACCESSORY MOUNTING RAIL

(71) Applicant: Law Enforcement Intelligent Devices, LLC, Auburn Hills, MI (US)

(72) Inventors: Peter Kujawski, Bedford, NH (US); Robert Suber, Columbia, SC (US); David Foster, Clarkston, MI (US)

(73) Assignee: Law Enforcement Intelligent Devices, LLC, Auburn Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/034,229

(22) Filed: Sep. 28, 2020

(65) Prior Publication Data

US 2021/0010772 A1 Jan. 14, 2021

Related U.S. Application Data

(63) Continuation of application No. 16/658,324, filed on Oct. 21, 2019, now Pat. No. 10,830,548.

(60) Provisional application No. 62/748,764, filed on Oct. 22, 2018.

(51) Int. Cl.

| | |
|---|---|
| ***F41A 17/06*** | (2006.01) |
| ***F41G 11/00*** | (2006.01) |
| *F41G 1/54* | (2006.01) |

(52) U.S. Cl.

CPC ..... *F41A 17/063* (2013.01); *F41G 11/003* (2013.01); *F41G 1/545* (2013.01)

(58) Field of Classification Search

CPC ..... F41G 11/003

USPC ..... 42/90, 70.01, 70.11, 106

See application file for complete search history.

(56) References Cited

U.S. PATENT DOCUMENTS

| | | | | |
|---|---|---|---|---|
| 4,488,370 | A | 12/1984 | Lemelson | |
| 6,226,913 | B1 | 5/2001 | Haimovich et al. | |
| 8,720,092 | B2 | 5/2014 | Beretta et al. | |
| 9,784,535 | B1 | 10/2017 | Cheng et al. | |
| 10,830,548 | B2 * | 11/2020 | Kujawski | F41A 17/063 |

(Continued)

FOREIGN PATENT DOCUMENTS

| | | | |
|---|---|---|---|
| EP | 1729081 | A1 | 12/2006 |
| EP | 2524420 | B1 | 3/2016 |
| WO | 20100107324 | A1 | 9/2010 |

OTHER PUBLICATIONS

Department of Defense, "Dimensioning of Accessory Mounting Rail for Small Arms Weapons", MIL-STD-1913 (AR), Feb. 3, 1995, 11 pages.

*Primary Examiner* — Bret Hayes

(74) *Attorney, Agent, or Firm* — Reising Ethington P.C.

(57) ABSTRACT

A firearm includes a firearm identification tag carried in a space between lugs of an accessory mounting rail. A firearm accessory mounting rail assembly includes a firearm identification tag carried in a recoil groove of a Picatinny rail, and including a housing having geometry complementary to a lug of the Picatinny rail, and a transmitter carried in the housing. A firearm identification tag for a firearm accessory mounting rail includes a trapezoidal housing having geometry complementary to Picatinny rail geometry and configured to be press fit between Picatinny lugs, and including sides, a major base, a minor base, and legs between the bases disposed at acute angles to the major base.

11 Claims, 2 Drawing Sheets

(56) References Cited

U.S. PATENT DOCUMENTS

| | | | |
|---|---|---|---|
| 2009/0053678 | A1 | 2/2009 | Falkenhayn et al. |
| 2010/0229450 | A1 | 9/2010 | Becker |
| 2011/0252684 | A1 | 10/2011 | Ufer et al. |
| 2014/0223793 | A1 | 8/2014 | Peterson et al. |
| 2014/0327516 | A1 | 11/2014 | Eckerdt |
| 2016/0033221 | A1 | 2/2016 | Schmehl et al. |
| 2017/0097209 | A1 | 4/2017 | Rocco et al. |
| 2017/0162030 | A1 | 6/2017 | Rajnath |
| 2018/0196628 | A1 | 7/2018 | Sarno |
| 2018/0216906 | A1 | 8/2018 | Gonzalez |
| 2018/0364000 | A1 | 12/2018 | Sims |

* cited by examiner

FIREARM IDENTIFICATION TAG FOR ACCESSORY MOUNTING RAIL

CROSS-REFERENCE TO RELATED APPLICATIONS

This application is a continuation of U.S. application Ser. No. 16/658,324, filed on Oct. 21, 2019 and published as U.S. Pub. No. 2020124368, which in turn claims the benefit of U.S. Provisional Application No. 62/748,764 filed on Oct. 22, 2018. The entire contents of each of the aforementioned applications are hereby incorporated by reference.

TECHNICAL FIELD

This disclosure relates generally to firearms and, more particularly, to firearm identification devices.

BACKGROUND

A typical handgun includes, among other things, a hand grip, a frame extending from the hand grip, a trigger guard extending between the hand grip and the frame, a trigger within the trigger guard, a slide carried atop the frame, and a barrel carried between the slide and the frame. The frame may include an accessory mounting rail that is slotted to define spaced apart dovetail-shaped lugs and spaces therebetween. Various accessories, such as lights, laser pointers, and the like can be mounted to the mounting rail and can include a body that has a channel that slides over the lugs of the rail and that is fastenable to the rail with a set screw.

Additionally, some handguns have been known to include an electronic identification device, which may be carried in an interior space of a hand grip or embedded in the hand grip material, as disclosed in U.S. Pat. No. 6,226,913 and EP 1729081. But such configurations can be complex, costly to implement, and require cooperation of handgun manufacturers.

Therefore, the apparent solution is to incorporate the electronic identification device into a handgun accessory body having a dovetail channel for sliding over the dovetail-shaped lugs of the accessory mounting rail, as disclosed in U.S. Pat. No. 8,720,092 and US 2016/0033221. But such a configuration may have its own shortcomings.

DETAILED DESCRIPTION

In general, a firearm identification tag is configured to be carried in a space between lugs of an accessory mounting rail of a firearm. The firearm identification tag will be described with reference to its use with one or more examples of a handgun that includes a Picatinny rail. However, it will be appreciated as the description proceeds that the firearm identification tag is useful in many different applications and may be implemented in many other firearm embodiments, including rifles, shotguns, or any other firearms, which have a Picatinny rail, Weaver rail, NATO accessory rail, M-LOK rail, KeyMod rail, simple dovetail rail, or any other presently known or future type of accessory mounting rail suitable for use with the disclosed firearm identification tag. In this regard, and as used herein and in the claims, it will be understood that the term "firearm" refers not only to handgun applications, but also to any other firearm applications including any type of accessory mounting rail suitable for use with the disclosed firearm identification tag.

Figure 1:
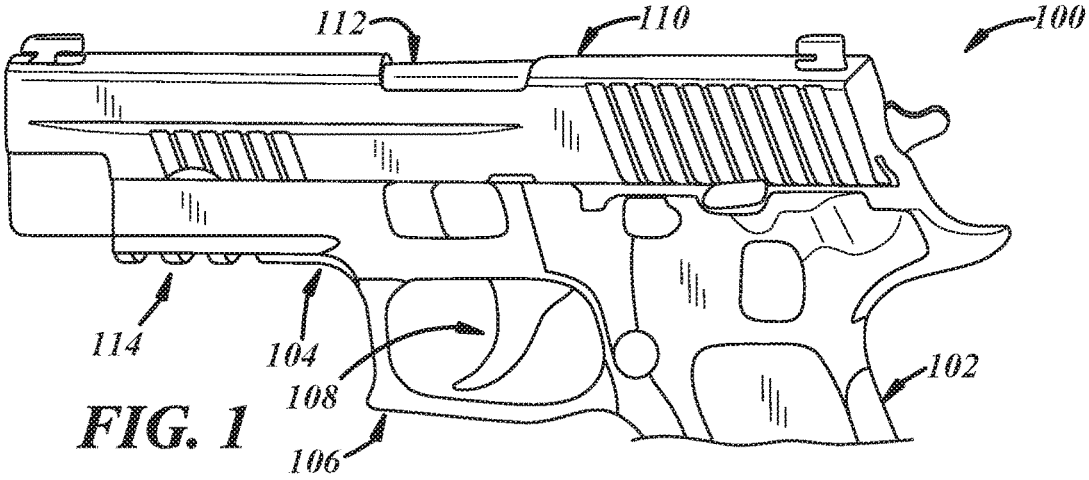
FIG. 1 is a fragmentary side view of a handgun having an accessory mounting rail.

Referring specifically to the drawings, FIG. 1 shows an illustrative embodiment of a firearm 100 in the form of a handgun including a hand grip 102, a frame 104 extending away from the hand grip 102, a trigger guard 106 extending between the hand grip 102 and the frame 104, a trigger 108 pivotably coupled to the frame 104 and confined within the trigger guard 106, a slide 110 carried atop the frame 104, a barrel 112 carried between the slide 110 and the frame 104, and an accessory mounting rail 114 carried by the frame 104. In the illustrated embodiment, the accessory mounting rail 114 is disposed on an underside of the firearm frame 104 in a location forward of the trigger guard 106. But in other embodiments, the rail 114 may be carried by any other suitable portion of the firearm 100. The accessory mounting rail 114 may be an integral portion of the firearm 100, or may be a component separate from the firearm 100 and coupled thereto by fastening, welding, interference fitting, or in any other suitable manner. In other embodiments, the frame 104 may include a serialized receiver assembly, whereas the accessory mounting rail 114 and the hand grip 102 and/or the trigger guard 106, may be a separate disposable portion of the firearm 100.

Figure 2:
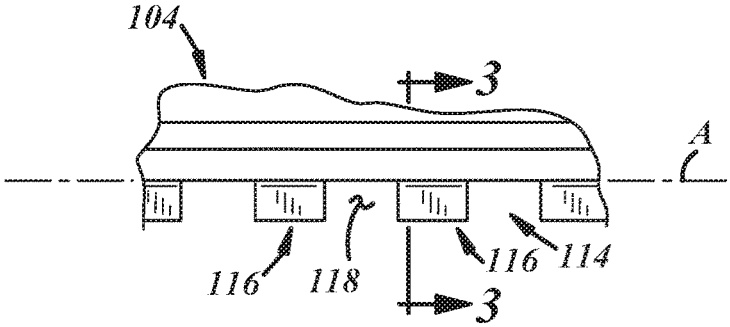
FIG. 2 is an enlarged fragmentary side view of a portion of the accessory mounting rail of FIG. 1.
Figure 3:
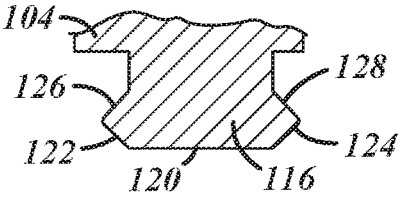
FIG. 3 is an enlarged fragmentary sectional view of a portion of the accessory mounting rail of FIG. 1, taken along line 3-3 of FIG. 2.
Figure 4:
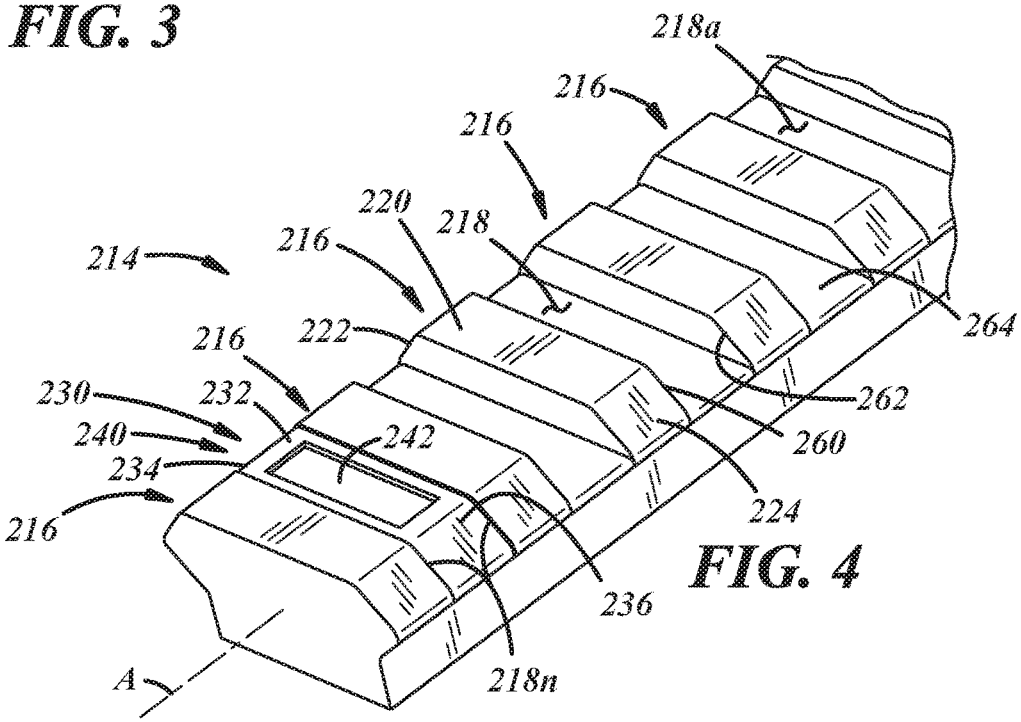
FIG. 4 is a fragmentary perspective view according to an illustrative embodiment of an accessory mounting rail carrying an illustrative embodiment of a firearm identification tag including a housing and a transmitter carried in the housing.

With additional reference to FIGS. 2-4, the accessory mounting rail 114 extends along a longitudinal axis A and is configured with tenons or lugs 116, and spaces 118 between the lugs 116. Although not shown, any accessory, such as a sight, a laser pointer, or the like can be mounted to the accessory mounting rail 114 and can include a body that has a mortise or channel for sliding over the lugs 116 of the rail 114 and that may be securable thereto with a set screw or via any other securing or fastening arrangement. In any case, the accessory mounting rail 114 may be a Picatinny rail wherein the lugs 116 are dovetailed or of wedge-shaped profile or, more specifically, of an elongated hexagonal T-shaped profile, when viewed along the longitudinal axis A of the rail 114. Picatinny rails are known and described in US military specification MIL-STD-1913 (3 Feb. 1995). The lugs 116 of a Picatinny rail are uniformly spaced apart with one or more recoil grooves 118 therebetween. The lugs 116 include outboard bases 120, outboard legs 122, 124 extending outwardly away from the bases 120, and inboard legs 126, 128 extending inwardly away from the outboard legs 122, 124. Again, the accessory mounting rail 114 need not be a Picatinny rail, and can include any form or configuration of an accessory mounting rail suitable for use with the presently disclosed subject matter.

FIG. 4 illustrates another illustrative embodiment of a firearm accessory mounting rail 214. This embodiment is similar in many respects to the embodiment of FIGS. 1-3 and like numerals between the embodiments generally designate like or corresponding elements throughout the several views of the drawing figures. Accordingly, the descriptions of the embodiments are hereby incorporated into one another, and description of subject matter common to the embodiments generally may not be repeated.

The rail 214 may include a plurality of lugs 216 and spaces 218 including a forward-most space 218*a* and a rearward-most space 218*n* that may be relatively proximate a firearm grip and relatively distal a firearm barrel end (not shown). Also, the accessory mounting rail 214 carries a firearm identification tag 230 in one of the spaces 218 between the lugs 216, for instance, entirely within a space 218, for example, the rearward-most space 218*n* of the rail 214. The tag 230 may have geometry that is complementary to corresponding geometry of the accessory mounting rail 214, for instance, as shown in FIG. 4. More specifically, the tag 230 may have exposed outer surfaces that are complementary in shape to corresponding exposed outer surfaces of the lugs 216. Even more specifically, the tag 230 may include a minor base 232 and legs 234, 236 extending therefrom that may have surfaces substantially in parallel with corresponding surfaces of corresponding outboard bases 220 and outboard legs 222, 224 of the rail 214. As used herein, the phrase "substantially in parallel" means parallel within plus or minus five angular degrees, including all ranges, sub-ranges, endpoints, and values in that range.

The firearm identification tag 230 may be carried by the rail 214 by fastening, adhering, and/or interference fitting the tag 230 into the space 218 between the lugs 216. For instance, a sight adjustment device may be used to press fit the tag 230 into place, such as that disclosed in U.S. Pat. No. 9,784,535. In other embodiments, the tag 230 may be thermally fit to the rail 214, by heating the rail 214 and/or cooling the tag 230, sliding the tag 230 into the space 218, and allowing the temperature(s) to normalize to establish the fit. In any case, the tag 230 may be inserted into the space 218 in a direction transverse, if not perpendicular, to the longitudinal axis A of the rail 214.

In some embodiments, the tag 230 may include a housing 240, and an identification (ID) transmitter 242 separate from the housing 240 and carried in a void of the housing 240, for instance in a void open to the minor base 232 of the tag 230. The transmitter 242 may be recessed below the plane of the minor base 232. In other embodiments, the tag 230 may not include a separate housing 240 and, instead, may include an ID transmitter 242 in the shape of the housing 240 without the void.

In any case, the ID transmitter 242 may be a stand-alone transmitter, or may be part of a transponder, transceiver, or any other device suitable to transmit data, including ID data to a receiver (not shown). The ID transmitter 242 may include a contactless device, operable via electromagnetic radiation, such as via radio frequency identification device (RFID) technology adapted for any frequency range and protocol suitable for use with firearms. In other embodiments, the ID transmitter 242 may operate via optics, magnetics, or any other physical, or even chemical, phenomena suitable for use with firearms. For instance, the ID transmitter 242 may include a contact-type memory chip having contacts exposed for contact with any suitable type of memory reader. The ID transmitter 242 may be used to embody or store identifying information and/or to transmit energy, signals, data, or the like that may help, for example, locate firearms and/or regulate firearm use.

FIGS. 5-8 illustrate another illustrative embodiment of a firearm identification tag 330 that can be used with the accessory mounting rail 214 of FIG. 4. This embodiment is similar in many respects to the embodiment of FIG. 4 and like numerals between the embodiments generally designate like or corresponding elements throughout the several views of the drawing figures. Accordingly, the descriptions of the embodiments are hereby incorporated into one another, and description of subject matter common to the embodiments generally may not be repeated In FIGS. 5-8, the firearm identification tag 330 includes a housing 340 carrying a transmitter 342. The housing 340 may be of trapezoidal shape including sides 344, 346, a major base 348, a minor base 350, and legs 352, 354 between the bases 348, 350 disposed at acute angles to the major base 346. More specifically, the housing 340 may be of generally isosceles trapezoidal shape, for instance, wherein the acute angles are identical within plus or minus five angular degrees including all ranges, sub-ranges, endpoints, and values in that range. A void may be disposed between the bases 348, 350 and the legs 352, 354, and may be entirely surrounded by material of the housing 340, such that the transmitter 342 may be entirely encapsulated by the housing 340. Additionally, the housing 340 may include rounds 356 (FIG. 7) between the legs 352, 354 and the major base 348, and rounds 358 (FIG. 8) between the sides 344, 346 and the major base 348.

In any case, the sides 344, 346 of the tag 330 (FIGS. 5-8) correspond to sides 260, 262 of the lugs 216 (FIG. 4), and the major base 348 of the tag 330 (FIGS. 5-8) corresponds to a rail base 264 of the rail 214 (FIG. 4). When the tag 330 (FIGS. 5-8) is assembled to the accessory mounting rail 214 (FIG. 4), the tag sides 344, 346 (FIGS. 5-8) may contact the lug sides 260, 262 (FIG. 4), and the tag major base 348 (FIGS. 5-8) may contact the rail base 264 (FIG. 4). The width of the tag 330 may be such that the distance between the tag sides 344, 346 (FIGS. 5-8) may be greater than the distance between lug sides 260, 262 (FIG. 4) across the space 218, such that there is an interference fit of the tag 330 to the rail 214. In a non-limiting example, the width of the space 218 between the lug sides 260, 262 may be 0.206" whereas the width of the tag 330 may be 0.2147". Of course, those of ordinary skill in the art will recognize that any other suitable dimensions, and any suitable tolerances, may be used, and may be application specific. Similarly, the maximum height of the tag 330, as measured between the major base 348 and the minor base 350, may be less than the maximum height of the lugs 216, as measured from the rail base 264 to the lug minor base 220. Likewise, the maximum length of the tag 330, as measured across the length of the major base 348, may be shorter than the corresponding maximum length of the lugs 216, as measured transversely across the lugs 216.

As shown in FIG. 4, the tag housing 240 may be recessed, or at least flush, with respect to adjacent corresponding portions of the firearm accessory mounting rail 214. More specifically, the minor base 232 and legs 234, 236 may be recessed, or at least flush, with respect to the minor base 220 and legs 222, 224 of adjacent lugs 216 of the rail 214. Accordingly, the firearm identification tag 230 can be carried in the spaces 118 between the lugs 116 of the rail 114 in a low-profile manner, for instance, for avoiding interference with mounting of accessories to the rail 114, for avoiding discomfort to a user, and/or for a streamlined appearance. Accordingly, the tags 230, 330 may have a tag profile in transverse cross section that is contained within an envelope established by a lug profile in transverse cross section, or even may have a tag profile that is coplanar with the lug profile.

Figure 5:
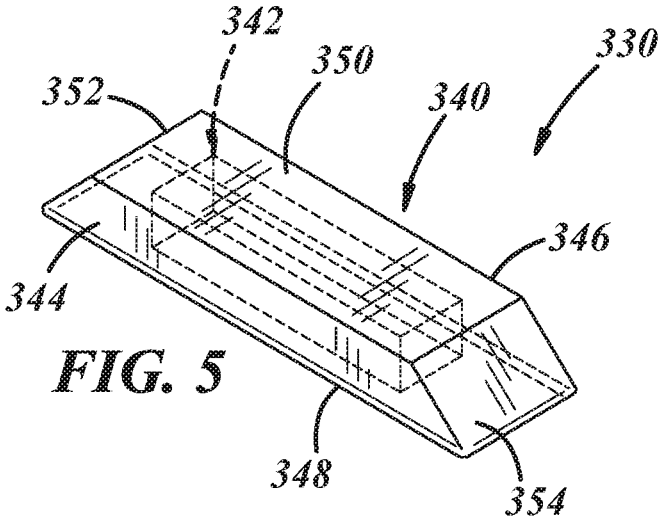
FIG. 5 is a perspective view of another illustrative embodiment of a firearm identification tag.
Figure 6:
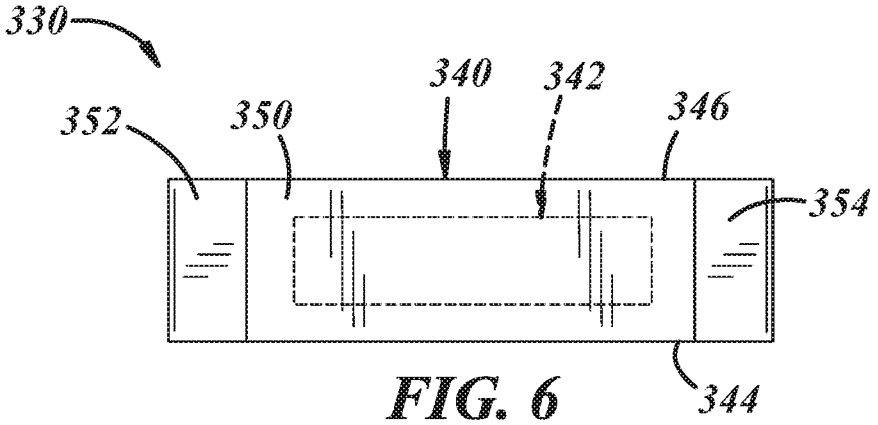
FIG. 6 is a top view of the tag of FIG. 5.
Figure 7:
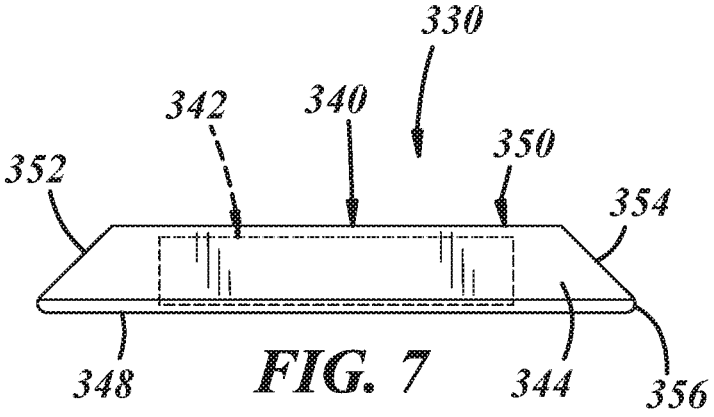
FIG. 7 is a side view of the tag of FIG. 5.
Figure 8:
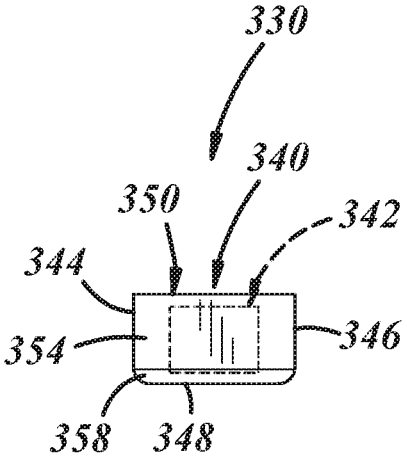
FIG. 8 is an end view of the tag of FIG. 5.

With reference to FIGS. 4 and 5, the tag housings 136, 236 may be composed of polymeric, non-metallic, or any other material suitable for use with a firearm. Also, the tag housings 136, 236 may be produced by injection molding, casting, machining, or any other manufacturing technique suitable for use in making a transmitter housing.

The presently disclosed subject matter may offer one or more of the following benefits. Complimentary geometry between the firearm identification tag and the firearm accessory mounting rail is streamlined such that it may not interfere with a holster in which the firearm is carried, with other firearm-mounted accessories, or with operation, sighting, or performance of the firearm. Also, the firearm identification tag is of extremely low weight such that it may not add much mass to the firearm and, thus, tends to not affect balance or shooting accuracy of the firearm. Additionally, the color of the firearm identification tag can be complimentary to the firearm frame so as be difficult to visually detect by users. Moreover, locating the firearm identification tag on the underside of the firearm promotes pointing of the firearm in a direction away from others (straight up or down) during reading of the tag.

As used in this patent application, the terminology "for example," "for instance," "like," "such as," "comprising," "having," "including," and the like, when used with a listing of one or more elements, is open-ended, meaning that the listing does not exclude additional elements. Likewise, when preceding an element, the articles "a," "an," "the," and "said" mean that there are one or more of the elements. Moreover, directional words such as front, rear, top, bottom, upper, lower, radial, circumferential, axial, lateral, longitudinal, vertical, horizontal, transverse, and/or the like are employed by way of example and not limitation. As used herein, the term "may" is an expedient merely to indicate optionality, for instance, of an element, feature, or other thing, and cannot be reasonably construed as rendering indefinite any disclosure herein. Other terms are to be interpreted and construed in the broadest reasonable manner in accordance with their ordinary and customary meaning in the art, unless the terms are used in a context that requires a different interpretation.

Finally, the present disclosure is not a definitive presentation of an invention claimed in this patent application, but is merely a presentation of examples of illustrative embodiments of the claimed invention. More specifically, the present disclosure sets forth one or more examples that are not limitations on the scope of the claimed invention or on terminology used in the accompanying claims, except where terminology is expressly defined herein. And although the present disclosure sets forth a limited number of examples, many other examples may exist now or are yet to be discovered and, thus, it is neither intended nor possible to disclose all possible manifestations of the claimed invention. In fact, various equivalents will become apparent to artisans of ordinary skill in view of the present disclosure and will fall within the spirit and broad scope of the accompanying claims. Features of various implementing embodiments may be combined to form further embodiments of the invention. Therefore, the claimed invention is not limited to the particular examples of illustrative embodiments disclosed herein but, instead, is defined by the accompanying claims.

The invention claimed is:

1. A firearm, comprising:

an accessory mounting rail including lugs and a space therebetween; and a firearm identification tag carried in the space between the lugs, wherein the firearm identification tag is flush or recessed with respect to adjacent corresponding portions of the firearm accessory mounting rail.

2. The firearm set forth in claim 1, wherein the accessory mounting rail includes a plurality of spaces including a forward-most space and a rearward-most space, and wherein the firearm identification tag is carried in the rearward-most space.

3. The firearm set forth in claim 1, wherein the accessory mounting rail is disposed on an underside of the firearm.

4. The firearm set forth in claim 1, wherein the firearm identification tag includes:

a housing having a void; and a transmitter carried in the void.

5. The firearm set forth in claim 1, wherein the firearm identification tag is interference fit into the space between the lugs.

6. The firearm set forth in claim 1, wherein the firearm identification tag has geometry complementary to corresponding geometry of the accessory mounting rail.

7. The firearm set forth in claim 1, wherein the firearm identification tag includes surfaces substantially in parallel with corresponding surfaces of the rail.

8. The firearm set forth in claim 1, wherein the firearm identification tag comprises a trapezoidal housing including sides, a major base, a minor base, and legs extending between the bases at acute angles to the major base.

9. The firearm set forth in claim 1, wherein the firearm identification tag includes an RFID transponder.

10. The firearm set forth in claim 1, wherein the accessory mounting rail is a Picatinny rail.

11. The firearm set forth in claim 1, wherein the firearm identification tag includes an identification transmitter used to embody or store identifying information and/or to transmit energy, signals, or data to facilitate location of the firearm and/or regulate use of the firearm.

* * * * *